United States Patent [19]

Zeimes

[11] Patent Number: 4,852,523

[45] Date of Patent: Aug. 1, 1989

[54] ATMOSPHERIC GAS BOILER

[75] Inventor: Manfred Zeimes, Hilden, Fed. Rep. of Germany

[73] Assignee: Thyssen Industrie AG, Fed. Rep. of Germany

[21] Appl. No.: 149,437

[22] Filed: Jan. 29, 1988

[30] Foreign Application Priority Data

Jan. 29, 1987 [DE] Fed. Rep. of Germany ..... 3702600
Feb. 19, 1987 [DE] Fed. Rep. of Germany ..... 3705230

[51] Int. Cl.[4] ..... F22B 5/00
[52] U.S. Cl. ..... 122/14; 122/19; 122/156; 122/367 C
[58] Field of Search ..... 122/14, 16, 17, 18, 122/19, 44 A, 155 A, 156, 367 C, 225 A; 126/350 R

[56] References Cited

U.S. PATENT DOCUMENTS 4,432,307 2/1984 Godin ..... 122/14
4,501,232 2/1985 Gordbegli et al. ..... 122/367 C

FOREIGN PATENT DOCUMENTS 2144204 2/1985 United Kingdom ..... 122/367 C

*Primary Examiner*—Edward G. Favors
*Attorney, Agent, or Firm*—McGlew & Tuttle

[57] ABSTRACT

An atmospheric gas boiler has two vertically arranged end pieces and at least one middle piece arranged between them, as well as burner lances disposed in the lower part of the gas boiler. The pieces of the boiler through which hot water flows define a furnace, with secondary heating surfaces adjoining thereto. In order to lower the quantity of NOX arising during the combustion, the middle piece has a tongue through which hot water flows, extending into the furnace. The tongue possesses cooling ribs on the outside, which extend into the adjoining furnace spaces.

8 Claims, 1 Drawing Sheet

ATMOSPHERIC GAS BOILER

BACKGROUND OF THE INVENTION

FIELD OF THE INVENTION

This invention relates in general to boilers, and in particular to a new and useful atmospheric gas boiler which includes three spaced apart vertically elongated parts defining vertical gas passes there between in a lower area which communicates three new gas passes which together with the gas passes defines a furnace area into which burner lances discharge.

The invention particularly concerns an atmospheric gas boiler with two vertically arranged terminal pieces and at least one middle piece arranged between them as well as burner lances arranged in the lower part of the gas boiler, whereby the elements of the boiler through which hot water flows have a furnace with secondary heating surfaces adjoining thereon.

Such gas boilers are used primarily as central heating boilers. There is no blower in an atmospheric gas boiler. Therefore, the furnace has an opening for ingress of secondary air, while the primary air is suctioned in through a mix pipe of the burner or the burner lances.

In an atmospheric gas boiler of this type, the middle piece or pieces extend only in the region of the secondary heating surfaces and terminate above the furnace. Hence, relatively high flame and exhaust gas temperatures can arise in the furnace, thereby favoring the formation of NOX.

SUMMARY OF THE INVENTION

The purpose of the invention is to lower the quantity of NOX arising from combustion in gas boilers.

This purpose is achieved by the fact that the middle piece has a tongue extending into the furnace, through which hot water flows, while on the outside of the tongue there are cooling ribs which extend into the adjoining furnace spaces.

In this way, the transfer of heat to the hot water begins in the furnace, or in the furnace spaces formed by the tongue or the tongues. Consequently, the combustion temperatures and also the exhaust gas temperature lie in a region where no significant formation of NOX occurs.

Each tongue of a middle piece should have at least one breach, connecting the adjoining furnace spaces, in order to allow an equalization of temperature and/or pressure between the adjoining furnace spaces.

It is expedient to have air inlet openings (for secondary air) formed in the bottom part between the adjoining pieces, in whose vicinity the burner lances are disposed. For now the thermal energy produced in the furnace or the furnace spaces can be thoroughly and efficiently transferred to the hot water in the boiler pieces.

Radiative losses from the furnace can be avoided especially if the projection surface of one or more adjacent burner lances in a projection on the air inlet openings is the same as, or greater than, the surface of the air inlet openings.

Moreover, the thermal radiation given off by the burner lances themselves can be utilized if the burner lances are disposed along their height at least partially between the walls of the water conducting cavities of the pieces, the distance of these walls from a burner lance being smaller than the overall width of the overall diameter of the particular burner lance or lances. It is of advantage if the walls of the water conducting cavities in the vicinity of the burner lances follow the contour of the lances. At the same time, this assures that the secondary air supplied through the air inlet openings is specifically fed to the flames issuing from each burner lance. The burner lances can be introduced into the boiler laterally. The formation of a low quantity of NOX is further encouraged if inlet openings for combustion air emerge into the furnace spaces.

Accordingly, it is an object of the invention to provide an improved gas boiler construction which includes three vertically elongated parts including a central part and two end parts with vertical gas passes defined between the end parts and the central part which communicate in the lower portion of the gas boiler in a furnace area into which final lances extend wherein the central part defines a tongue in the furnace area.

A further object of the invention is to provide a gas boiler which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

GENERAL DESCRIPTION OF THE PREFERRED EMBODIMENTS

Figure 1:
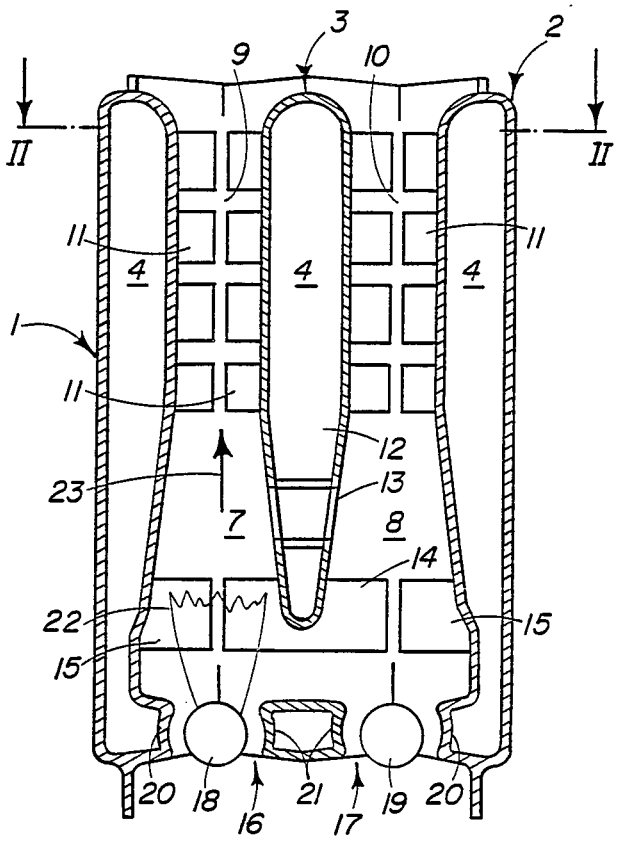
FIG. 1 is a schematic vertical section through an atmospheric gas boiler constructed in accordance with the invention.
Figure 2:
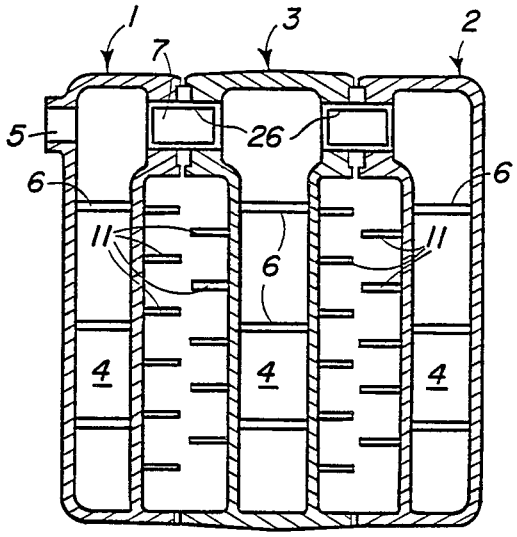
FIG. 2 is a horizontal section taken along the line II—II of FIG. 1

Referring to the drawings in particular the invention embodied therein comprises an atmospheric gas boiler which comprises two end pieces 1, 2 and at least one middle piece arranged between these. Only one middle piece 3 is shown. Several middle pieces of the same type can also be arranged between the end pieces.

The end pieces 1 and 2 and the middle piece 3 have continuous, water conducting cavities 4, to which hot water is supplied via an inlet 5. The inlet 5 is located at the end piece 1. Through connecting tubes 26, the hot water also gets into the cavities 4 of the adjoining middle piece 3 and, if present, those of the other middle pieces, and also into the cavity 4 of the other end piece 2. The heated hot water is taken away from the gas boiler through a drain, not shown.

The pieces 1,2,3 of the gas boiler are held together in the conventional manner with anchors 6. The abutting surfaces between the individual pieces 1,2,3 are sealed tight such as by welds in the familiar manner.

As can be discerned in FIG. 1, especially, the pieces 1,2,3 of the gas boiler are hollow over their entire height. In their lower part, they define furnace spaces 7 and 8 and upper secondary heating surfaces 9 and 10, adjoining thereto, which have flat cooling ribs 11. The cooling ribs can also be configured as needlelike ribs.

The middle piece 3 has a water carrying tongue 12, which extends into the region of the combustion zone and borders on the two adjacent furnace spaces 7,8. In the region of the furnace spaces 7,8 the tongue 12 has at least one breach 13, in order to allow an equalization of pressure and temperature between the two furnace spaces 7,8. At the lower end of the tongue 12 there are cooling ribs 14, which extend into the adjoining furnace spaces 7,8. Corresponding cooling ribs 15 also emerge from the walls of the end pieces 1 and 2 bordering the furnace spaces 7 and 8. The cooling ribs 14 and 15 are also configured as plane ribs.

The cavities 4 of the pieces 1,2,3 extend, as shown, into the bottom region of the gas boiler. Here, that is, in the bottom region, between the adjacent pieces 1,2,3 there are downwardly open air inlet openings 16, 17, in which burner lances 18, 19 are disposed, being inserted through side openings of the gas boiler, not shown. In the depicted configuration, only one burner lance 18 or 19 is shown in the region of each air inlet opening 16 or 17. Instead of one lance, there can be several burner lances arranged alongside each other. Each burner lance 18 or 19 extends basically over the enter width of the corresponding furnace space 7 or 8. The surface area of each of the burner lances is equal to or greater than the surface of an adjacent piece defining the inlet openings.

Each air inlet opening 16 or 17 is bounded off by tonguelike segments 20, 21 of the end pieces 1 or 2 and of the middle piece 3. The walls of these segments 20, 21 facing the burner lances 18, 19 are brought up rather close against the burner lances 18, 19 and follow the contour of the cylindrical burner lances 18, 19 at a certain distance. This configuration assures, on the one hand, that radiation of heat from the furnace spaces 7, 8 through the air inlet openings 16, 17 is prevented. On the other hand, the thermal radiation given off by the burner lances 18 and 19 is intercepted by the tonguelike segments 20, 21 and thereby utilized to heat the hot water. Finally, the secondary air is also specifically supplied to the combustion in the indicated flame region 22. The cooling ribs 14 and 15 and the tongue 12 extending between the furnace spaces 7 and 8 carry off so much heat to the hot water already in the vicinity of the furnace spaces 7 and 8 that the combustion temperatures obtaining in the furnace spaces 7 and 8 remain in the region not critical to formation of notable quantities of NOX. The hot exhaust gases flow out of the furnace spaces 7, 8 in the direction of the arrow 23, past the ensuing secondary heating surfaces 9 and 10, and leave the gas boiler through a drain, not shown.

Air inlet openings for combustion air, e.g., in the form of channels led to the outside by the end pieces 1 and 2, which are not shown in the drawings, emerge into the furnace spaces 7,8. This enables an afterburning in the furnace spaces, further lowering the content of NOX in the exhaust gas.

While a specific embodiment of the invention has been shown and described in detail to illustrate the application of the principals of the invention, it will be understood that the invention may be embodied otherwise without departing from such principles.

What is claimed is:

1. An atmospheric gas boiler, comprising two vertically arranged end pieces and at least one middle piece disposed between said end pieces and defining vertically extending gas passes between said middle piece and each of said end pieces and a lower part having an interconnection between said gas passes and defining a furnace area, said end and middle pieces having passages through which hot water flows and defines secondary heating surfaces, said middle piece having a tongue extending into said furnace area through which hot water flow, said tongue having cooling rims on its exterior which extend into adjacent gas passes.

2. An atmospheric gas boiler, comprising two vertically arranged end pieces and at least one middle piece disposed between said end pieces and defining vertically extending gas passes between said middle piece and each of said end pieces and a lower part having an interconnection between said gas passes and defining a furnace area, said end and middle pieces having passages through which hot water flows and defines secondary heating surfaces, said middle piece having a tongue extending into said furnace area through which hot water flows, said tongue having cooling rims on its exterior which extend into adjacent gas passes, said tongue having at least one breach therein interconnecting said gas passes of said furnace area.

3. A gas boiler according to claim 2, wherein said end pieces and said middle piece define air inlet openings therebetween the lower ends thereof between adjacent pieces and including a burner lance disposed in each of the spaces between adjacent pieces in said air inlet openings.

4. A gas boiler according to claim 3, wherein the surface area of each said burner lance is at least equal to the surface of an adjacent piece defining said inlet openings.

5. A gas boiler according to claim 3, wherein each of said end pieces and said middle piece defines spaces there between at their lower ends defining inlets, and a burner in each of these spaces between said ends pieces and said middle piece, said distance of the walls of said end pieces and said middle piece from said lances there between being smaller than the overall width of the overall diameter of the burner lance.

6. A boiler according to claim 3, wherein the water conducting surfaces of said middle and end pieces face each said burner lance and follow the contour of said burner lance in spaced relationship thereto.

7. A gas boiler according to claim 2, including a burner lance between each of said end pieces and the associated middle piece, said boiler having a side opening for into which said boiler lances are introduced.

8. A gas boiler according to claim 2, wherein said end pieces and said middle piece define air inlet openings there between for combustion air emerges into a furnace area.

* * * * *